US008886098B2

(12) United States Patent
Fromm

(10) Patent No.: US 8,886,098 B2
(45) Date of Patent: Nov. 11, 2014

(54) APPARATUS AND METHOD TO CONTROL MEDIA WRINKLING THROUGH ROLL FLARING

(75) Inventor: Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 242 days.

(21) Appl. No.: 13/047,277

(22) Filed: Mar. 14, 2011

(65) Prior Publication Data

US 2012/0237275 A1 Sep. 20, 2012

(51) Int. Cl.
*G03G 15/20* (2006.01)

(52) U.S. Cl.
CPC .... *G03G 15/2053* (2013.01); *G03G 2215/2032* (2013.01); *G03G 2215/2061* (2013.01); *G03G 2215/00151* (2013.01)
USPC ..... 399/329; 399/333

(58) Field of Classification Search
CPC ..... G03G 15/2053; G03G 2215/2061; G03G 2215/00151; G03G 2215/2032
USPC ..... 399/329; 492/27
See application file for complete search history.

(56) References Cited

U.S. PATENT DOCUMENTS

| | | | | |
|---|---|---|---|---|
| 3,884,623 | A | 5/1975 | Slack | |
| 3,999,038 | A | 12/1976 | Sikes, Jr. et al. | |
| 4,008,955 | A | 2/1977 | Bar-on | |
| 4,042,804 | A | 8/1977 | Moser | |
| 4,170,175 | A | 10/1979 | Conlon, Jr. | |
| 5,450,181 | A | 9/1995 | Tsukida et al. | |
| 5,689,788 | A | 11/1997 | Moser | |
| 5,737,679 | A | 4/1998 | Uehara et al. | |
| 6,266,510 | B1 | 7/2001 | Curry et al. | |
| 6,969,021 | B1 | 11/2005 | Nibarger | |
| 7,403,737 | B2 | 7/2008 | Coleman et al. | |
| 7,570,912 | B2 | 8/2009 | Fromm et al. | |
| 7,580,666 | B2 * | 8/2009 | Kimura | 399/328 |
| 2001/0037849 | A1 * | 11/2001 | Corey et al. | 156/73.4 |
| 2004/0149710 | A1 * | 8/2004 | Sanpei et al. | 219/216 |
| 2004/0183860 | A1 * | 9/2004 | Furukawa | 347/55 |
| 2005/0201783 | A1 * | 9/2005 | Kurotaka et al. | 399/329 |
| 2011/0064491 | A1 * | 3/2011 | Kono et al. | 399/329 |

FOREIGN PATENT DOCUMENTS

JP 2003263047 A * 9/2003

* cited by examiner

*Primary Examiner* — David Gray
*Assistant Examiner* — Tyler Hardman
(74) *Attorney, Agent, or Firm* — Ronald E. Prass, Jr.; Prass LLP

(57) ABSTRACT

According to aspects of the embodiments, an electrophotographic system utilizing a belt roll fuser mechanism which inhibits or minimizes wrinkling or slipping of printed media through the fuser is disclosed. In this device, the belt is driven at the ideal velocity at all locations across the width of the roll with minimal differential shear stress between the internal pressure roll and the inside of the belt in the nip and around the wrap. The ideal velocity is achieved by straining the circumference belt while its mounted on a roll support structure by flaring the other rolls equally and flaring the internal pressure roll to match the strained circumference of the belt. A small flaring of the rolls in the belt module would reduce sliding of the belt and make the transition between the wraps or the stripper shoe less stressful.

20 Claims, 5 Drawing Sheets

APPARATUS AND METHOD TO CONTROL MEDIA WRINKLING THROUGH ROLL FLARING

BACKGROUND

This disclosure relates in general to an electrophotographic system, and more particularly, to the controlling of wrinkling of printed pages in belt roll fuser.

Generally, in a commercial electrostatographic reproduction apparatus (such as copier/duplicators, printers or the like), a latent image charge pattern is formed on a uniformly charged photoconductive or dielectric member. Pigmented marking particles (toner) are attracted to the latent image charge pattern to develop such image on the dielectric member. A receiver member, such as paper, is then brought into contact with the dielectric member and an electric field applied to transfer the marking particle developed image to the receiver member from the dielectric member. After transfer, the receiver member bearing the transferred image is transported away from the dielectric member and the image is fixed or fused to the receiver member by heat and/or pressure to form a permanent reproduction thereon. In a typical fusing process where the toner is fused to the paper or receiving member, two rolls are used through which the paper travels during the toner fusing. One roll, usually the harder roll, is a fuser roll, the second roll is the pressure roll or the softer roll.

Typical pressure rolls ("Softer Roll") that are used in a fusing system have an elastomeric coating like silicone rubber which may or may not have a thin layer of another material over the surface of the roll. A functional nip is formed when the softer roll is pressed into the fuser roll ("Harder Roll"). The fuser roll generally comprises a metal core with a hard coating or thin elastomer.

In any system when a hard roll (fuser roll) is pressed against and contacts a softer roll nips are formed throughout the length of the pressure roll in contact with the fuser roll. These pressure zones ultimately cause the softer material to contact the support plates and create wear, shortening roll life and causing debris in the system. Also, once excessive wear takes place and an uneven nip is formed, improper fusing of the toner can result causing imperfect copies on the paper or receiving member. Also, a non-uniform nip causes uneven contact with the paper, uneven fusing of the toner, paper wrinkles and excessive rubbing against a support plate causes the roll to wear and create debris in the system.

SUMMARY

According to aspects of the embodiments, an electrophotographic system utilizing a belt roll fuser mechanism which inhibits or minimizes wrinkling or slipping of printed media through the fuser is disclosed. In this device, the belt is driven at the ideal velocity profile at all locations across the width of the roll with minimal differential shear stress between the internal pressure roll and the inside of the belt in the nip and around the wrap. The ideal velocity profile is achieved by straining the belt while its mounted on a roll support structure by flaring the rolls equally and flaring the internal pressure roll to match the strained circumference of the belt. A small flaring of all the rolls in the belt module would reduce sliding of the belt and make the transition between the wraps or the stripper shoe less stressful than flaring only one roller.

DETAILED DESCRIPTION

Figure 1:
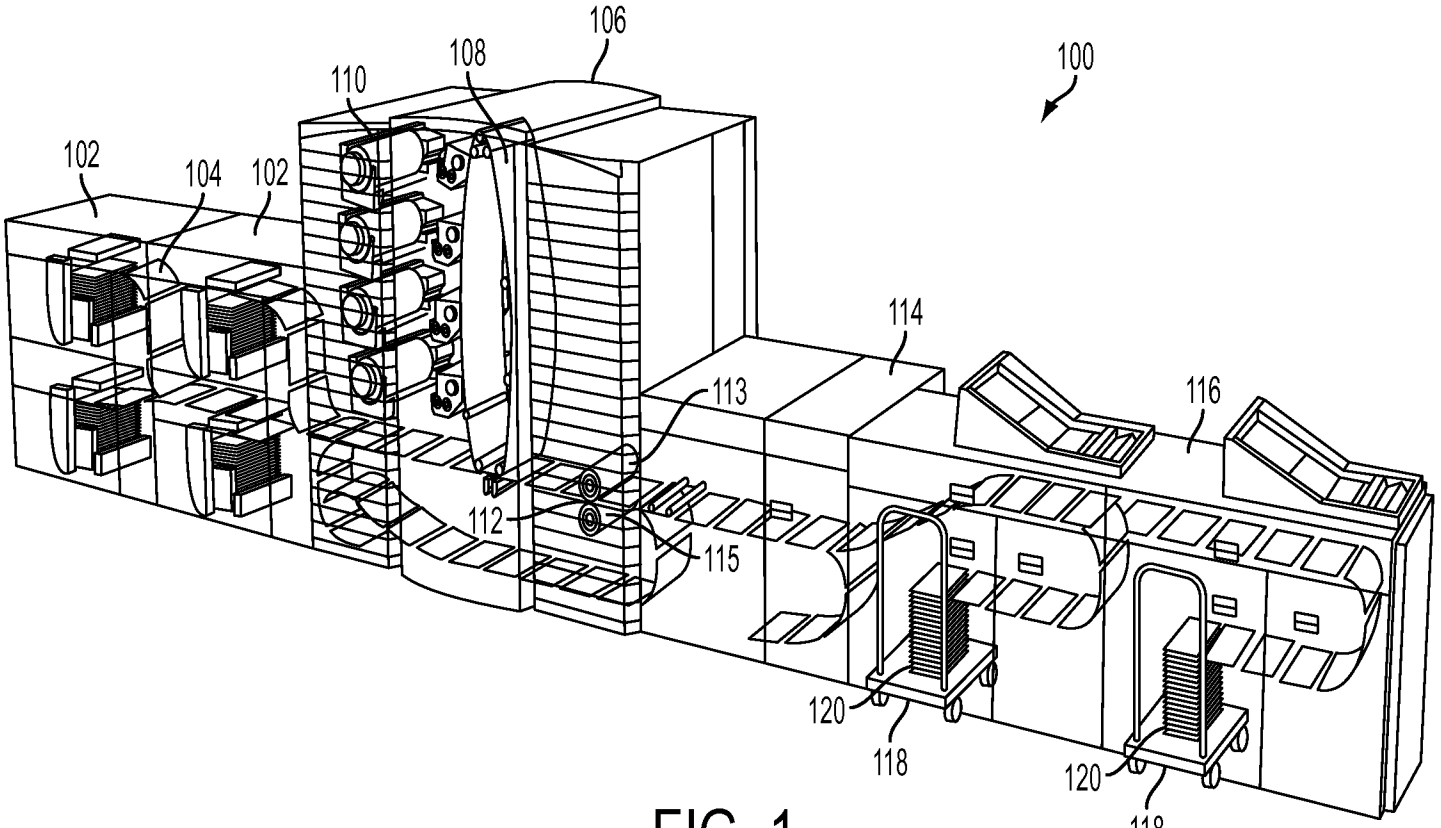
FIG. 1 depicts an exemplary embodiment of a printing apparatus in accordance to an embodiment.

Aspects of the embodiments disclosed herein relate to methods and corresponding apparatus to provide wrinkle control in a belt-roll fuser by flaring all of the rollers in the system that guide the belt. A flare on the guide rollers would induce strain in the belt, stretching it and thereby inducing a velocity profile on the belt surface, as it passes through the nip. The velocity profile is such that it gradually increases from center to the outer edges (media side edges), thus reducing the propensity to create a wrinkle in the media by puffing the trail edge tight.

The disclosed embodiments include an apparatus useful for printing, comprising a belt including an inner surface and an outer surface; a first member including a first outer surface; a second member including a second outer surface, wherein the second outer surface is substantially cylindrical over a central major portion and flaring outwardly with increasing diameter at each end; a plurality of rollers mounted to a frame for defining a path along which the belt is driven in a process direction, the plurality of rollers comprising a drive roller having a longitudinal axis about which it is mounted to rotate and a drive surface formed generally concentrically about the longitudinal axis, wherein the drive surface is substantially cylindrical over a central major portion and flaring outwardly with increasing diameter at each end; a nip formed by contact between the inner surface of the belt and the second outer surface and contact between the outer surface of the belt and the first outer surface; wherein the second member and plurality of rollers cause the belt to be larger in circumference at its ends than at its central major portion, thereby the belt circumference near the belt side edge is larger than the circumference in the central portion of the belt induced belt circumference strain that causes a velocity profile that inhibits wrinkle of a print media on the outer surface of the belt as the print media passes through the nip.

The disclosed embodiments further include an apparatus wherein each of the plurality of rollers have a differential diameter between central major portion and ends from about 0.001 mm to 0.200 mm.

The disclosed embodiments further include an apparatus wherein the second member has a differential diameter between central major portion and ends from about 0.001 mm to 0.090 mm.

The disclosed embodiments include a method for reducing wrinkling of a print media in a printer having a belt for transporting the print media, a pressure roll (contacting the back of the media), an internal pressure roll, and transport rollers for driving belt in a process direction, the method comprising providing an internal pressure roll with flaring at each end, wherein the flaring causes the internal pressure roll to be substantially cylindrical over a central major portion thereof substantially corresponding to the width of the belt and flaring outwardly with increasing diameter at each end thereof; providing a plurality of transport rollers with flaring ends to define a path along which the belt is driven in a process direction, wherein the flaring causes each end of a plurality of transports to be substantially cylindrical over a central major portion thereof substantially corresponding to the width of the belt and flaring outwardly with increasing diameter at each end thereof; forming a nip by contact between the belt and the internal pressure roll and contact between the belt and the pressure roll; wherein the second member (internal pressure roll) and plurality of rollers cause the belt to be larger in circumference at its ends than at its central major portion, thereby locations on the belt towards the ends of the second member an induced belt circumference strain causes a velocity profile that inhibits wrinkle of a print media on the outer surface of the belt as the print media passes through the nip.

The disclosed embodiments further include a contact belt fusing apparatus with rollers to reduce print media wrinkling, the fusing apparatus comprising an endless fusing belt having an external surface defining a path of movement; a plurality of support rollers for supporting and moving the endless fusing belt along the path of movement, the endless fusing belt as supported having a first fusing position centered axially on the plurality of support rollers at a first location, and at least a second fusing position centered axially on the plurality of support rollers at a second location spaced axially from the first location thereon; a pressure roller forming a fusing nip with the external surface of the endless fusing belt for contacting and moving therethrough the print media; and belt strain inducing flares at the internal pressure roller and plurality of support rollers to reduce wrinkling of the print media by inducing a strain on the endless fusing belt to causes a velocity profile that inhibits wrinkle of the print media as the print media passes through the fusing nip.

The term "roller" or "drive roller" refer to a rotatably supported generally cylindrical member for directly engaging a belt. A "roller assembly" includes a roller or steering roller as well as additional support structure that allow the rollers to operate as desired. Rollers include rotating cylinders, as well as driven elements, journalled on bearings and a shaft.

The term "print media" generally refers to a usually flexible, sometimes curled, physical sheet of paper, plastic, or other suitable physical print media substrate for images, whether precut or web fed.

The term "printing apparatus", "printer", or "printing system" refers to one or more devices used to generate "printouts" or a print outputting function on a "print media", which refers to the reproduction of information on "print media" for any purpose. A "printing apparatus", "printer", or "printing system" encompasses any apparatus, such as a digital copier, bookmaking machine, multi-function machine, and the like, that can perform a print outputting function for any purpose.

The term "electrophotographic system" is a printing apparatus and is intended to encompass image reproduction machines, electrophotographic printers and copiers that employ an electrophotographic process such as dry toner developed on an electrophotographic receiver element. A "xerographic system" is a printing apparatus that employs a xerographic process, which refers to the use of a resinous powder, such as toner, on an electrically charged plate, roller or belt and reproduce information, or other suitable processes for generating printouts on a print media, such as an ink jet process, a liquid ink process, a solid ink process, and the like. Also, such systems can print and/or handle either monochrome or color image data.

FIG. 1 illustrates an exemplary printing apparatus 100, as disclosed in U.S. Pat. No. 7,633,647 by Mestha et al. for "Method for spatial color calibration using hybrid sensing systems", which is incorporated herein by reference in its entirety. The printing apparatus 100 can be used to produce prints from various types of media at high speeds. The media can have various sizes and weights. The printing apparatus 100 includes two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 are adapted to feed coated or uncoated media having various sizes and weights to the printer module 106. In the printer module 106, marking material (toner) is transferred from a series of developer stations 110 to a charged photoreceptor belt 108 to form toner images on the photoreceptor belt and produce color prints. The toner images are transferred to one side of media 104 fed through the paper path. The media are advanced through a fuser 112, described in detail below in FIG. 2 with reference to apparatus 200 that includes a fuser roll 113 and pressure roll 115. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

In the illustrated printing apparatus 100, the fuser roll 113 and the pressure roll 115 forms a nip at which heat and pressure is applied to media carrying marking material to treat the marking material. The fuser roll 113 can include an outer layer made of an elastomeric material having an outer surface region that experiences strain when the fuser roll 113 and pressure roll 115 are engaged with each other. This strain is also referred to herein as "creep." In the fuser 112, creep of the outer layer of the fuser roll 113 is used to strip media from the fuser roll 113 after the media pass through the nip. In such fusers, high creep is typically required to strip less-rigid, light-weight media, while lower creep is required to strip more-rigid, heavy-weight media. Creep is typically not adjusted other than during service calls.

Another type of fuser includes a pressure roll and a thick belt for treating marking material on media. Thick belts typically have a thickness of about 1 mm to about 5 mm. In such fusers, creep that occurs in the belt is used for stripping media from the belt.

It has been noted that it is difficult to simultaneously optimize both marking material treating and media stripping functions for all media weights in apparatuses that include a pressure roll and thick belt. For example, when such fusers are operated using the same creep and nip width conditions for all media weights, instead of using the optimal conditions for each different media type, light-weight media can be over-fused, while heavy-weight media can generate excessive edge-wear in the thick belts.

Apparatuses useful for printing are provided. Embodiments of the apparatuses include a belt. In embodiments, the belt and another member, such as an external pressure roll or a second belt, form a nip. One or more rolls supporting the belt can be heated to control the temperature of the belt. At the nip, the belt and external roll apply heat and/or pressure to treat marking material on media. The media are then separated (stripped) from the belt. Embodiments of the apparatuses are constructed to separate the marking material treatment function (e.g., fusing) from the media stripping function to provide extended belt life.

Figure 2:
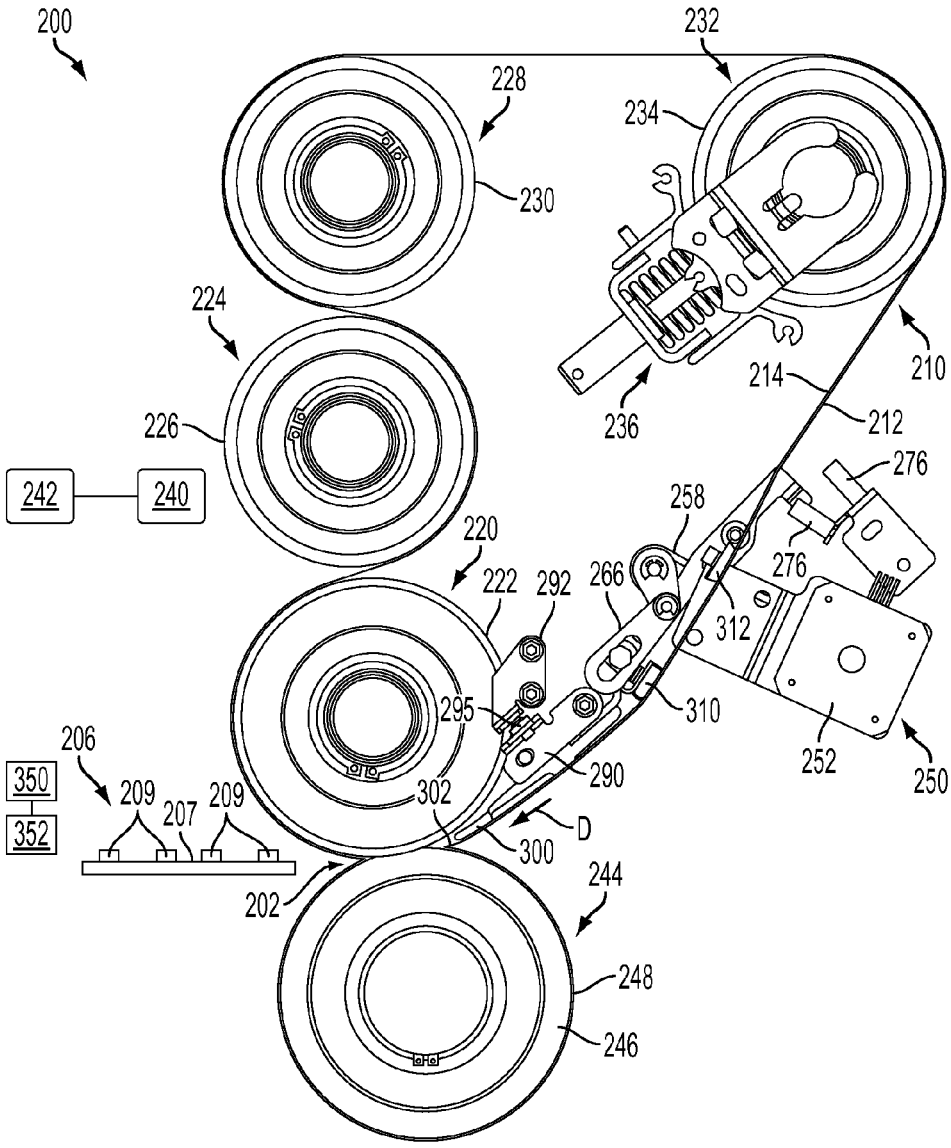
FIG. 2 depicts an exemplary embodiment of a belt roll module with flared rolls to minimize wrinkling of a print media in accordance to an embodiment.

FIG. 2 illustrates an exemplary embodiment of an apparatus useful for printing. The apparatus is a fuser 200. The fuser 200 is constructed to decouple the marking material treatment function (e.g., fusing function) and the media stripping function for all media weights that may be used in the fuser. Embodiments of the fuser 200 can be used in different types of printing apparatuses. For example, the fuser 200 can be used in the printing apparatus 100 shown in FIG. 1, in place of the fuser 112.

As shown in FIG. 2, the fuser 200 includes an endless (continuous) belt 210 supported by an internal pressure roll 220, an external roll 224 and internal rolls 228 and 232. Other embodiments of the fuser 200 can have different architectures including a different number of rolls supporting the belt 210. The internal roll 232 includes a steering and tensioning mechanism 236 to allow re-positioning of the internal roll 232 and adjustment of the tension in the belt 210.

The belt 210 includes an outer surface 212 and an inner surface 214. The internal pressure roll 220 and the internal rolls 228, 232 include respective outer surfaces 222, 230 and 234 contacting the inner surface 214 of the belt 210. The external roll 224 includes an outer surface 226 contacting the outer surface 212 of the belt 210. In embodiments, at least the external roll 224 and the internal roll 228 are heated. The internal pressure roll 220 and/or the internal roll 232 can optionally also be heated. In embodiments, the external roll 224 and the internal roll 228, and optionally the internal pressure roll 220 and/or the internal roll 232, include an internal heat source (not shown), such as one or more axially-extending lamps. The heat sources can be electrically connected to a power supply 240. In embodiments, the power supply 240 is electrically connected to a controller 242. The controller 242 is adapted to control the power supply 240 to control the power output of the heat sources in order to control the temperature of the belt 210 during warm-up, standby and print runs. The belt 210 can be heated to a temperature effective to treat (e.g., fuse) marking material on different types of coated or un-coated media.

The fuser 200 further includes an external pressure roll 244 having an outer layer 246 with an outer surface 248. In embodiments, the outer layer 246 is comprised of an elastically deformable material, such as silicone rubber, and the outer surface 248 is comprised of durable wear resistant and oil impermeable material such as perfluoroalkoxy (PFA) copolymer resin, or the like.

Embodiments of the belt 210 can have a multi-layer construction including, e.g., a base layer, an intermediate layer on the base layer, and an outer layer on the intermediate layer. In such embodiments, the base layer forms the inner surface 214 of the belt 210 contacting the outer surfaces 222, 230 and 234 of the internal pressure roll 220 and the internal rolls 228, 232, respectively. The outer layer of the belt 210 forms the outer surface 212 contacting the outer surface 226 of the external roll 224 and the outer surface 248 of the external pressure roll 244. In an exemplary embodiment of the belt 210, the base layer is composed of a polymeric material, such as polyimide, or the like; the intermediate layer is composed of silicone, or the like; and the outer layer is composed of a polymeric material, such as a fluoroelastomer sold under the trademark Viton® by DuPont Performance Elastomers, L.L.C., polytetrafluoroethylene (Teflon®), or the like.

In embodiments, the belt 210 may have a thickness of about 0.1 mm to about 0.6 mm, and be referred to as a "thin belt." For example, the base layer can have a thickness of about 50 μm to about 100 μm, the intermediate layer a thickness of about 100 .mu.m to about 500 .mu.m, and the outer layer a thickness of about 20 .mu.m to about 40 .mu.m. The belt 210 can typically have a width of about 350 mm to about 450 mm, and a length of about 500 mm to 1000 mm, or even longer.

In embodiments, the one or more outer elastomeric layers of the belt 210 are sufficiently thin, and the outer surface 222 of the internal pressure roll 220 is sufficiently hard, and the outer surface 248 of the external pressure roll 244 is sufficiently soft that the elastomeric layer(s) experience only minimal creep when the outer surface 222 and the outer surface 248 of the external pressure roll 244 engage the belt 210. These features can minimize relative motion between media and the outer surface 212 of the belt 210 at the nip 202. By using a thin belt 210, the fuser 200 does not rely on creep to strip media from the belt 210.

Figure 3:
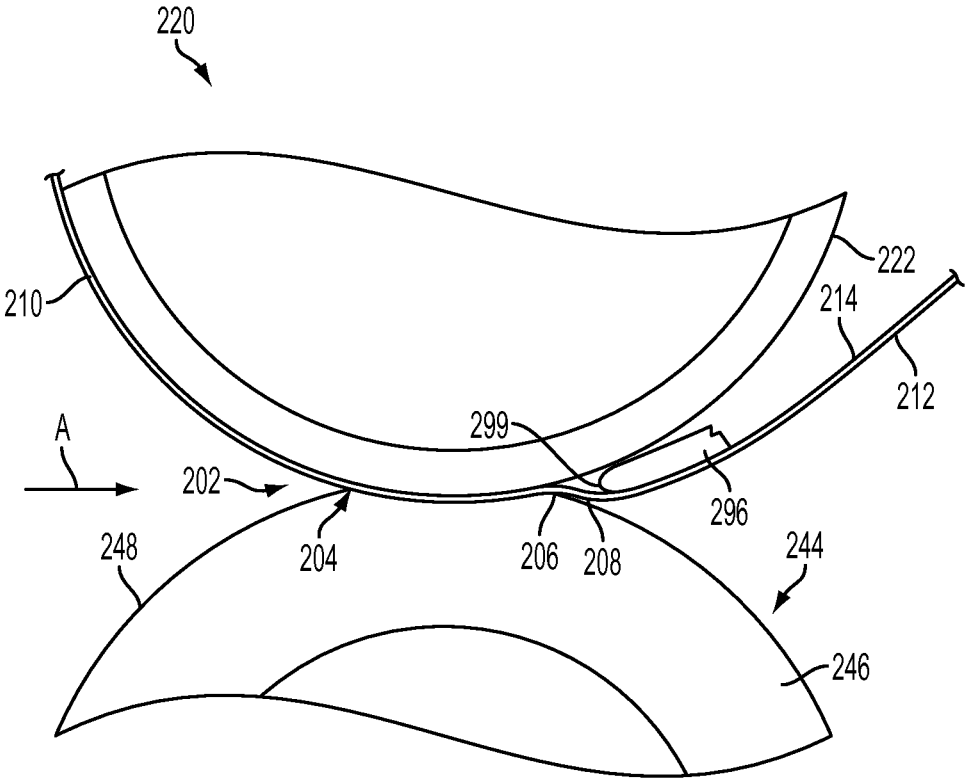
FIG. 3 depicts a view of a belt interposed between the inner pressure roll and the outer pressure roll to form a nip in accordance to an embodiment.

FIG. 2 depicts a medium 206 being fed to the nip 202 in the process direction A as shown in FIG. 3. The medium 206 includes a surface 207 on which marking material 209 (e.g., toner) is present. The surface 207 and marking material 209 contact the outer surface 212 of the belt 210 at the nip 202. The nip 202 is also referred to herein as the "first nip." In embodiments, the internal pressure roll 220 is rotated counter-clockwise, and the external pressure roll 244 is rotated clockwise, to convey the medium 206 through the first nip 202 in the process direction A and rotate the belt 210 counter-clockwise.

The medium 206 can be a print media, sheet of paper, a transparency or packaging material, for example. Paper is typically classified by weight, as follows: lightweight: less than or equal to (≤=) about 90 gsm, midweight: about 90 gsm to about 160 gsm, and heavyweight: greater than or equal to (≥=) 160 gsm. For toner, a low mass is typically less than about 0.8 g/cm.sup.2 $cm^2$. The medium 206 can be, e.g., light-weight paper, and/or the marking material 209 can have a low mass, or the medium 206 can be a heavy-weight type, e.g., heavy-weight paper or a transparency, and/or the marking material 209 can have a high mass (e.g., at least about 0.8 g/cm.sup.2). A larger amount of energy (both per thickness and per basis weight) is used to treat marking material (e.g., fuse toner) on coated media than on uncoated media.

The first nip 202 is the high-pressure nip of the fuser 200. In embodiments, the outer layer 246 of the external pressure roll 244 is deformed when the outer surface 248 is engaged with the belt 210 to form the first nip 202 between the outer surface 248 and the outer surface 212. The outer surface 222 of the internal pressure roll 220 may also be deformed by this contact depending on the material forming the outer surface 222. The fuser 200 further includes a stripping mechanism 300 (252 is a motor to move 300) or 296 as shown in FIG. 3 for stripping media from the outer surface 212 of the belt 210 after the media exit from the first nip 202 traveling in the process direction A as shown in FIG. 3. The motor 252 of the stripping mechanism 250 is connected to a stripping controller 350 in a conventional manner. The sensor 276 is also connected to the stripping controller 350. In the illustrated embodiment, a media sensor 352 is located upstream of the first nip 202 to sense media before arriving at the first nip 202.

A common problem with fusing mechanisms is the creasing of the print media as it passes through the fuser nip. Several factors, including environment, relative humidity, media type, entry conditions, and nip mechanics, can affect the tendency of a fuser to damage media. Regardless of the cause, creased, wrinkled pages result in lost time, lost paper, and lost patience, as printing process have to be repeated over again in order to get a non-creased product. While the issue of wrinkling and creasing has been addressed extensively in the fuser roll context, because the mechanics are different and somewhat more intricate, it has not been addressed extensively in the context of a belt fuser mechanism. Wrinkling reduction strategies have included large flares of the internal pressure roll and the sleeved pressure roll, shaping the rolls with different profiles such as concave or convex profiles, and others have suggested applying pressure only at its edges in order to minimize stresses at the middle of the roll. The prior art does not suggest the use of velocity profiling of a belt or present any approach to the issue of minimizing wrinkling of the printed page in a fuser belt context. In any case where a belt has not twisted around its axis all axial lines on the belt have make one revolution around the belt module in the same amount of time. The axial line may become non-straight at some portions of the rotation, like in the high pressure fuser nip, but on average all points along a line need to make one revolution in the same time interval. In the case of an elastomeric roller, the axial line on the surface definitely is distorted as it passes through the nip when the harder roller is profiled. This bending of the axial line is the typical means to generate a velocity profile in a roll fuser.

Similar distortion can be imposed on the belt by flaring the supporting rollers to make the path length longer on the ends the central portion to make the circumference of the belt is non-uniform, the local surface velocity is non-uniform given the belt angular velocity is uniform. The angular velocity of the belt must be uniform across the width or else it would accumulate a twist and wrinkling of the belt and destruction of the belt is a natural consequence. Obtaining a velocity distribution where the ends are faster than the middle ensures the media does not wrinkle. The velocity distribution is incrementally improved by increasing the number of flared rolls. For example, the velocity distribution when the set of rolls is flared is superior to a velocity distribution where only a subset of the rolls is flared. Thus the curvature of the belt across its width is convex, relative to the outside of the belt, on most wraps and concave in one wrap and flat between the wraps. The managing of the sum of these strains around all of the rolls creates a uniform velocity profile that minimizes the wrinkling of the belt. Even though the direction of the curvature is not the same at all locations, the direction of the lengthwise (circumference) strain is the same in all of the wraps.

Flaring the internal Pressure Roll 220 (IPR) with a flare that matches the strained shape of the belt so that all locations along its length match the velocity of the strained belt (small flare) and flaring equally the other rolls such as the belt module rolls will sufficiently to strain the belt to the desired velocity profile that reduces or minimizes print media wrinkling by producing a belt path length that is longer on the edges than the middle while producing no slip or relative motion of the belt inside surface 214 on the high pressure contact to the internal pressure roll surface 222 in the nip 202.

FIG. 3 depicts a portion of the fuser 200 shown in FIG. 2, including the internal pressure roll 220, external pressure roll 244, belt 210 between the outer surface 222 of the internal pressure roll 220 and the outer surface 248 of the external pressure roll 244, and a stripping member 296 of the stripping mechanism 250. As shown, the first nip 202 extends in the process direction between an inlet 204, where media enter the first nip, and an outlet shown where the media 206 exit from the first nip 202.

As shown in FIG. 3, the belt 210 separates from the outer surface 222 of the internal pressure roll 220 at the outlet where the media 206 exit of the first nip 202. The outer surface 212 of the belt 210 and the outer surface 248 of the external pressure roll 244 forms a second nip 208 downstream and adjacent to the outlet where the media 206 exit of the first nip 202. The outer surface 212 of the belt 210 applies pressure to the outer surface 248 of the external pressure roll 244. The pressure at the second nip 208 is lower than the pressure at the first nip 202. Typically, the second nip 208 pressure is about 10 psi to about 15 psi. The second nip 208 is used to facilitate stripping of media from the outer surface 212 of the belt 210.

Figure 4:
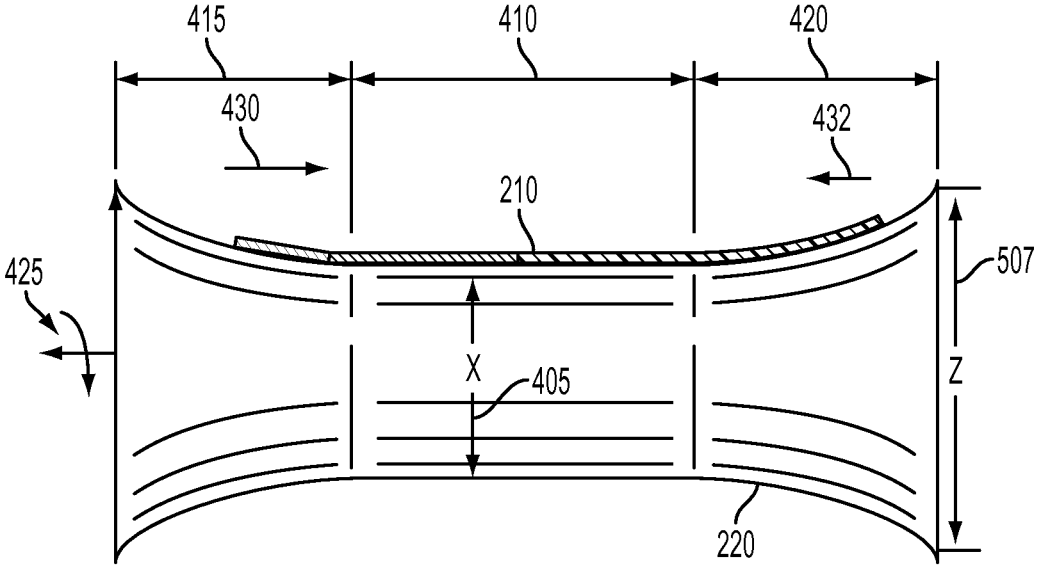
FIG. 4 is a cross sectional view of an internal pressure roll with flared ends and substantially cylindrical central major portion in accordance to an embodiment.

FIG. 4 is a cross sectional view of an internal pressure roll 220 with flared ends and substantially cylindrical central major portion in accordance to an embodiment. It will be noted that the internal pressure roll 220 is flared or hourglass shaped having a double taper extending from a flat section X at the central portion 405 of the internal pressure roll 220 and end diameter Z flaring outwardly with increasing diameter (increase circumference) at each end 507. The goal is to matched the percent circumference flare of the belt with equal percent diameter flare of the internal pressure roll 220 to drive the belt at the ideal velocity at all locations across the width of the roll with minimal differential shear stress between the internal pressure roll and the inside of the belt in the nip and around the wrap. For example, when the belt is nearly a meter in circumference, a 0.1% flare (0.001 Flare ratios) is one millimeter (1 mm) increase in circumference. The corresponding IPR 220 diameter flare would then be 90 micron for a 90 mm diameter roller. To strain the belt the rest of the 1 mm, the other 83 mm diameter belt rolls are flared 200 microns each as described in FIG. 5. Internal pressure roll 220 is shown having equal areas of positive curvature or linear increasing diameter 415 and 420 and an area of substantially zero curvature 410. Differential diameter between central major portion (X) and ends (Z) ranges from about 0.001 mm to 0.180 mm. The cylindrical zone of the roll 410 is approximately 25 to 75% the width of the fuser belt 210. As an example, as the endless (continuous) belt 210 travels across internal pressure roll 220 and experiences lateral shift, the belt enters an area of positive curvature 420. As the belt moves further up the positively curved portion of the internal pressure roll 220, the slope increases (increase belt diameter) which increases the restoring force 432 applied to the belt. This restoring force 432 is exerted on the belt to restore the belt to an optimal position in the area of substantially zero curvature 410. A restoring force 430 moves the belt to the zero curvature area of the internal pressure roll 220. The restoring forces 430 and 432 exerted on the belt as it moves into an area of positive curvature 410 arises from both the increased shear stress due to the curvature in the roller as well as the wrap angle of the belt on the roller and make the transition from the conical wrap shape to the planer shape between the wraps or the stripper shoe less stressful. As the endless (continuous) belt 210 moves 425 toward one end of the internal pressure roll an induced belt circumference strain causes a velocity profile that inhibits wrinkle of a print media on the outer surface of the belt as a print media passes through the nip.

Figure 5:
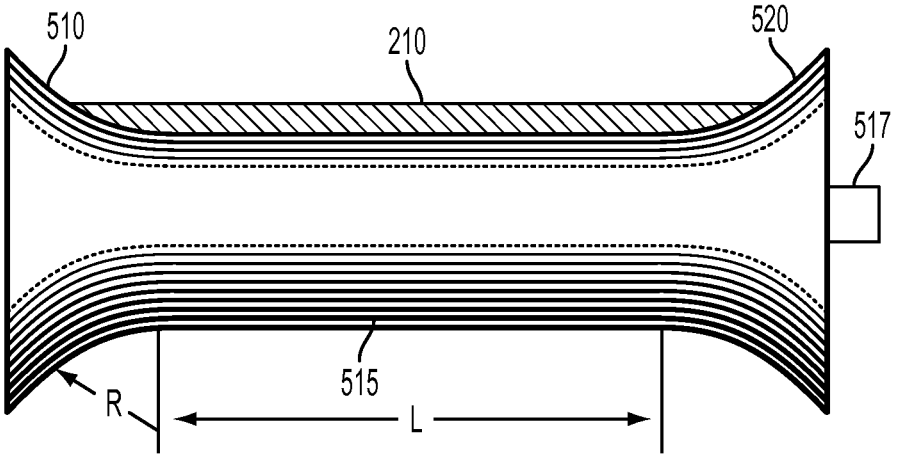
FIG. 5 is cross sectional view showing one of the pluralities of rollers mounted to a frame (guide rollers) having flared ends and substantially cylindrical central major portion in accordance to an embodiment.

FIG. 5 is cross sectional view showing one of the pluralities of rollers mounted to a frame (guide rollers) having flared ends and substantially cylindrical central major portion in accordance to an embodiment. The guide rollers were earlier described with reference to FIG. 2 as external roll 224 and internal rolls 228 and 232. The guide rollers are flared the same amounts since the rolls are common in all locations except for the internal pressure roll 220. Each roller comprises cylindrical central major portion 515 and flared end portions 510 and 520 rotating about shaft 517. The length L of central cylindrical major portion 515 is substantially the same as the width as the cylindrical major portion 410 of the internal pressure roll 220. End portions 510 and 520 flare outwardly in a curve to an increasing diameter at a smooth rate at a given radius R. The radius (R) can be very large. As shown the diameter increases as a function of the radius. Each of the plurality of rollers have a differential diameter between central major portion 515 and ends range from about 0.001 mm to 0.400 mm.

To develop the velocity distribution that provides wrinkle control, a strategy of straining the belt while it is mounted on the roll support structure (N roll module) by flaring N−1 of the rolls equally and flaring the internal pressure roll that forms the nip to match the strained circumference of the belt has been described. The goal is to make the path length the belt must follow longer on the belt edges than the center. This will force the circumference of the belt to be larger on the edges than the center. The percent circumference flare would be matched with equal percent diameter flare of the internal pressure roll to drive the belt at the ideal velocity at all locations across the width of the roll with minimal differential shear stress between the internal pressure roll and the inside of the belt in the nip and around the wrap. There would be differential shear stress at the interface of the belt and the other rollers.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An apparatus useful for printing, comprising:

a belt including an inner surface and an outer surface;

a first member including a first outer surface;

a second member including a second outer surface, wherein the second outer surface is substantially cylindrical over a central major portion and includes a first flaring that flares outwardly with increasing diameter at each end;

a plurality of identical guide rollers mounted to a frame for defining a path along which the belt is driven in a process direction, each of the plurality of guide rollers having a longitudinal axis about which it is mounted to rotate and a drive surface formed generally concentrically about the longitudinal axis, wherein each of the plurality of guide rollers has a drive surface that is substantially cylindrical over a central major portion and includes a second flaring that flares outwardly with increasing diameter at each end, the drive surface having a portion between two points thereon that extends along a line parallel to the rotational axis; and a nip formed by contact between the inner surface of the belt and the second outer surface and contact between the outer surface of the belt and the first outer surface;

wherein a desired strained shape of the belt is defined by a percentage increase in a length of the belt at its edges as compared to a length of the belt at its center, the first flaring is selected such that a percentage increase in the diameter of the second member at each end as compared to the diameter of the second member at its central major portion is equal to the percentage increase that defines the desired strained shape, the second flaring is selected such that the plurality of guide rollers strain the belt to the desired; strained shape, the percentage increase in diameter of the second flaring is different than the percentage increase in diameter of the first flaring.

2. The apparatus according to claim 1, wherein each of the plurality of guide rollers have a same differential diameter between central major portion and ends, the differential diameter being from about 0.001 mm to 0.400 mm.

3. The apparatus according to claim 2, wherein the second member has a differential diameter between central major portion and ends from about 0.001 mm to 0.200 mm.

4. The apparatus according to claim 3, wherein the belt has a substrate made from a heat-resistant resin.

5. The apparatus according to claim 4, wherein the substrate is made from a polyimide.

6. The apparatus according to claim 3, wherein a protective layer is provided between the belt and the first member.

7. The apparatus according to claim 1, wherein at least the first outer surface of the first member is made from an elastomeric material which is distorted when the nip is formed.

8. The apparatus according to claim 7, wherein the elastomeric material is selected from a group consisting of silicone elastomers, fluoroelastomers, ethylene propylene hexadiene, polytetrafluoroethylene, perfluoroalkoxy resins, and mixtures thereof.

9. A method for reducing wrinkling of a print media in a printer having a belt for transporting the print media, an external pressure roll, an internal pressure roll, and transport rollers for driving belt in a process direction, the method comprising:

providing an internal pressure roll with a first flaring at each end, wherein the first flaring causes the internal pressure roll to be substantially cylindrical over a central major portion thereof substantially corresponding to 25-75% of the width of the belt and flaring outwardly with increasing diameter at each end thereof;

providing a plurality of identical transport rollers each with substantially equally second flaring ends to define a path along which the belt is driven in a process direction, wherein the second flaring causes the plurality of transport rollers to be substantially cylindrical over a central major portion thereof substantially corresponding to 25-75% the width of the belt and flaring outwardly with increasing diameter at each end thereof, wherein a portion of the central major portion extends along a line that is parallel to a longitudinal axis of the transport rollers, wherein the belt is transported and strained; and forming a nip by contact between the belt and the internal pressure roll and contact between the belt and the external pressure roll;

wherein a desired strained shape of the belt is defined by a percentage increase in a length of the belt at its edges as compared to a length of the belt at its center, the first flaring is selected such that a percentage increase in the diameter of the internal pressure roll at each end as compared to the diameter of the internal pressure roll at its central major portion is equal to the percentage increase that defines the desired strained shape, the second flaring is selected such that the plurality of transport rollers strain the belt to the desired; strained shape, the percentage increase in diameter of the second flaring is different than the percentage increase in diameter of the first flaring.

10. The method according to claim 9, wherein each of the plurality of transport rollers have a differential diameter between central major portion and ends from about 0.001 mm to 0.400 mm.

11. The method according to claim 10, wherein the internal pressure roll has a differential diameter between central major portion and ends from about 0.001 mm to 0.200 mm.

12. The method according to claim 11, wherein the belt has a substrate made from a heat-resistant resin.

13. The method according to claim 11, wherein the substrate is made from a polyimide.

14. The method according to claim 11, wherein a protective layer is provided between the belt and the external pressure roll.

15. The method according to claim 9, wherein at least a first outer surface of the external pressure roll is made from an elastomeric material which is distorted when the nip is formed.

16. The method according to claim 15, wherein the elastomeric material is selected from a group consisting of silicone elastomers, fluoroelastomers, ethylene propylene hexadiene, polytetrafluoroethylene, perfluoroalkoxy resins, and mixtures thereof.

17. A contact belt fusing apparatus with rollers to reduce print media wrinkling, the fusing apparatus comprising:

an endless fusing belt having an external surface defining a path of movement;

a plurality of identical support rollers for supporting and moving the endless fusing belt along the path of movement, the endless fusing belt as supported having a first fusing position centered axially on the plurality of support rollers at a first location, and at least a second fusing position centered axially on the plurality of support rollers at a second location spaced axially from the first location thereon;

a heater to heat the external surface of the endless fusing belt;

a pressure roller forming a fusing nip with the external surface of the endless fusing belt for contacting and moving therethrough the print media; and a belt strain inducing first flare at each end of the pressure roller and a second flare at each end of each of the plurality of support rollers, a contact surface of the support rollers and a contact surface of the pressure roller extending along a line that is parallel to rotational axes of the respective support rollers, to reduce wrinkling of the print media by inducing a strain on the endless fusing belt to causes a velocity profile that inhibits slip of the print media as the print media passes through the fusing nip, wherein the second flare at each of the plurality of support rollers is equal, wherein a desired strained shape of the endless fusing belt is defined by a percentage increase in a length of the endless fusing belt at its edges as compared to a length of the endless fusing belt at its center, the first flares are selected such that a percentage increase in the diameter of the pressure roll at each end as compared to the diameter of the pressure roll at its central major portion is equal to the percentage increase that defines the desired strained shape, the second flare is selected such that the plurality of support rollers strain the belt to the desired strained shape, and the percentage increase in diameter of the second flare is different than the percentage increase in diameter of the first flare.

18. The apparatus according to claim 17, wherein the second flare causes a differential diameter between a central major portion and ends from about 0.001 mm to 0.400 mm.

19. The apparatus according to claim 18, wherein first flare causes a differential diameter between central major portion and ends from about 0.001 mm to 0.200 mm.

20. The apparatus according to claim 19, wherein the endless fusing belt has a substrate made from a polyimide.

* * * * *